US009726404B2

(12) United States Patent
Piesker et al.

(10) Patent No.: US 9,726,404 B2
(45) Date of Patent: Aug. 8, 2017

(54) COOLING SYSTEM WITH A PLURALITY OF SUBCOOLERS

(71) Applicant: AIRBUS OPERATIONS GMBH, Hamburg (DE)

(72) Inventors: Markus Piesker, Hamburg (DE); Martin Sieme, Hamburg (DE); Ahmet Kayihan Kiryaman, Hamburg (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 672 days.

(21) Appl. No.: 13/773,037

(22) Filed: Feb. 21, 2013

(65) Prior Publication Data

US 2013/0227975 A1 Sep. 5, 2013

Related U.S. Application Data

(60) Provisional application No. 61/602,629, filed on Feb. 24, 2012.

(30) Foreign Application Priority Data

Feb. 24, 2012 (EP) ..... 12001233

(51) Int. Cl.
*F25D 15/00* (2006.01)
*F25B 40/02* (2006.01)
*F25B 23/00* (2006.01)

(52) U.S. Cl.
CPC ..... *F25B 40/02* (2013.01); *F25B 23/006* (2013.01)

(58) Field of Classification Search
CPC ..... F25B 40/02; F25B 23/006; B64D 13/06; F28D 15/0266
USPC ..... 62/119, 115, 509; 165/144
See application file for complete search history.

(56) References Cited

U.S. PATENT DOCUMENTS

| | | | | |
|---|---|---|---|---|
| 3,675,441 | A | 7/1972 | Perez | |
| 4,176,526 | A * | 12/1979 | Missimer | 62/278 |
| 4,209,996 | A * | 7/1980 | Shaw | 62/175 |
| 5,243,837 | A | 9/1993 | Radermacher | |
| 5,333,677 | A * | 8/1994 | Molivadas | 165/272 |
| 5,752,391 | A * | 5/1998 | Ozaki et al. | 62/228.1 |
| 6,866,092 | B1 | 3/2005 | Molivadas | |
| 7,263,845 | B2 | 9/2007 | Lee | |
| 7,908,881 | B2 | 3/2011 | Kopko | |
| 7,921,655 | B2 | 4/2011 | Wyatt | |
| 8,484,984 | B2 * | 7/2013 | Spearing | F25B 23/006 62/228.3 |
| 8,651,172 | B2 * | 2/2014 | Wyatt et al. | 165/272 |

(Continued)

FOREIGN PATENT DOCUMENTS

| | | |
|---|---|---|
| CN | 101688695 | 3/2010 |
| DE | 10 2006 005 035 | 9/2007 |

(Continued)

OTHER PUBLICATIONS

European Search Report dated Jul. 27, 2012.

*Primary Examiner* — Elizabeth Martin
(74) *Attorney, Agent, or Firm* — Dickinson Wright

(57) ABSTRACT

A cooling system, in particular for use on board an aircraft, includes a cooling circuit allowing circulation of a two-phase refrigerant therethrough, an evaporator disposed in the cooling circuit, and a condenser disposed in the cooling circuit. A plurality of subcoolers is arranged in series in the cooling circuit downstream of the condenser.

17 Claims, 2 Drawing Sheets

(56) References Cited

U.S. PATENT DOCUMENTS

| | | | | |
|---|---|---|---|---|
| 2005/0076639 | A1* | 4/2005 | Shirk et al. | 60/520 |
| 2006/0065004 | A1 | 3/2006 | Lee | |
| 2006/0118292 | A1 | 6/2006 | Weber | |
| 2009/0000329 | A1 | 1/2009 | Colberg | |
| 2009/0077981 | A1 | 3/2009 | Wyatt | |
| 2010/0043475 | A1 | 2/2010 | Taras | |
| 2010/0107660 | A1* | 5/2010 | Kawano et al. | 62/77 |
| 2010/0251737 | A1 | 10/2010 | Roering | |
| 2011/0120164 | A1 | 5/2011 | Spearing | |
| 2012/0255711 | A1* | 10/2012 | Andres | 165/104.31 |
| 2013/0068430 | A1 | 3/2013 | Piesker | |
| 2013/0291575 | A1* | 11/2013 | Ito et al. | 62/119 |

FOREIGN PATENT DOCUMENTS

| | | |
|---|---|---|
| DE | 10 2009 011 797 | 9/2010 |
| DE | 10 2011 014 954 | 9/2012 |
| DE | 10 2011 121 745 | 6/2013 |
| EP | 1 380 799 | 1/2004 |
| EP | 1 643 197 | 4/2006 |
| WO | 2006/099378 | 9/2006 |
| WO | 2007/088012 | 8/2007 |
| WO | 2008/130412 | 10/2008 |
| WO | 2009/009164 | 1/2009 |
| WO | 2009/039057 | 3/2009 |

* cited by examiner

COOLING SYSTEM WITH A PLURALITY OF SUBCOOLERS

CROSS REFERENCE TO RELATED APPLICATIONS

This application is entitled to and claims the benefit of European Patent Application No. 12 001 233.1 and U.S. Provisional Application No. 61/602,629, both filed Feb. 24, 2012, the disclosures of which, including the specification, drawings and abstract, are incorporated herein by reference in their entirety.

FIELD

The invention relates to a cooling system for operation with a two-phase refrigerant which is in particular suitable for use on board an aircraft. Further, the invention relates to a method of operating a cooling system of this kind.

BACKGROUND

Cooling systems for operation with a two-phase refrigerant are known from DE 10 2006 005 035 B3, WO 2007/088012 A1, DE 10 2009 011 797 A1 and US 2010/0251737 A1 and may be used for example to cool food that is stored on board a passenger aircraft and intended to be supplied to the passengers. Typically, the food provided for supplying to the passengers is kept in mobile transport containers. These transport containers are filled and precooled outside the aircraft and after loading into the aircraft are deposited at appropriate locations in the aircraft passenger cabin, for example in the galleys. In order to guarantee that the food remains fresh up to being issued to the passengers, in the region of the transport container locations cooling stations are provided, which are supplied with cooling energy from a central refrigerating device and release this cooling energy to the transport containers, in which the food is stored.

In the cooling systems known from DE 10 2006 005 035 B3, WO 2007/088012 A1, DE 10 2009 011 797 A1 and US 2010/0251737 A1 the phase transitions of the refrigerant flowing through the circuit that occur during operation of the system allow the latent heat consumption that then occurs to be utilized for cooling purposes. The refrigerant mass flow needed to provide a desired cooling capacity is therefore markedly lower than for example in a liquid cooling system, in which a one-phase liquid refrigerant is used. Consequently, the cooling systems described in DE 10 2006 005 035 B3, WO 2007/088012 A1, DE 10 2009 011 797 A1 and US 2010/0251737 A1 may have lower tubing cross sections than a liquid cooling system with a comparable cooling capacity and hence have the advantages of a lower installation volume and a lower weight. What is more, the reduction of the refrigerant mass flow makes it possible to reduce the conveying capacity needed to convey the refrigerant through the cooling circuit of the cooling system. This leads to an increased efficiency of the system because less energy is needed to operate a corresponding conveying device, such as for example a pump, and moreover less additional heat generated by the conveying device during operation of the conveying device has to be removed from the cooling system.

In the prior art cooling systems the two-phase refrigerant typically is stored, in the form of a boiling liquid, in an accumulator which is disposed in a cooling circuit allowing circulation of the two-phase refrigerant therethrough. So as to avoid excess wear of a conveying device for discharging the two-phase refrigerant from the accumulator, which may, for example, be designed in the form of a pump, conveying gaseous refrigerant through the conveying device and the formation of gas bubbles (cavitation) in the conveying device should be prevented as far as possible. Cavitation typically is the result of a pressure decrease in the refrigerant due to an abrupt increase of the flow speed caused by rapidly moving pump components.

Non-published DE 10 2011 014 954 therefore proposes an accumulator arrangement for use in a cooling system suitable for operation with a two-phase refrigerant wherein the refrigerant is liquefied and subcooled in a condenser. The subcooled refrigerant exiting the condenser is guided through a heat exchanger disposed within the accumulator and thereafter is discharged into the accumulator. While flowing through the heat exchanger the subcooled refrigerant releases cooling energy to the refrigerant already received in the accumulator.

Further, non-published DE 10 2011 121 745 proposes an accumulator arrangement for use in a cooling system suitable for operation with a two-phase refrigerant, wherein a conveying device for conveying refrigerant from an accumulator is formed integral with the accumulator. The integration of the conveying device into the accumulator allows to dispense with a tubing connecting the accumulator to the conveying device, which, in particular during start-up of the cooling system might contain gaseous refrigerant.

SUMMARY

The invention is directed to the object to provide a reliable cooling system for operation with a two-phase refrigerant which allows a low-wear operation of a conveying device for conveying the refrigerant through a cooling circuit of the cooling system. Further, the invention is directed to the object to provide a method of operating a cooling system of this kind.

These objects are achieved by a cooling system having features of attached claims and a method of operating a cooling system having features of attached claims.

A cooling system, which is in particular suitable for use on board an aircraft for cooling heat generating components or food comprises a cooling circuit allowing circulation of a two-phase refrigerant therethrough. The two-phase refrigerant circulating in the cooling circuit is a refrigerant, which upon releasing cooling energy to a cooling energy consumer is converted from the liquid to the gaseous state of aggregation and is then converted back to the liquid state of aggregation. The two-phase refrigerant may for example be $CO_2$ or R134A ($CH_2F—CF_3$). Electric or electronic systems, such as avionic systems or fuel cell systems usually have to be cooled at a higher temperature level than food. For cooling these systems, for example Galden® can be used as a two-phase refrigerant. The evaporating temperature of Galden® at a pressure of 1 bar is approximately 60° C.

An evaporator of the cooling system, which forms an interface between the cooling circuit and a cooling energy consumer, is disposed in the cooling circuit. The evaporator may, for example, comprise a heat exchanger which provides for a thermal coupling of the refrigerant flowing through the first cooling circuit and a fluid to be cooled, such as for example air to be supplied to mobile transport containers for cooling food stored in the mobile transport containers or any heat generating component on board the aircraft. The two-phase refrigerant is supplied to the evaporator in its liquid state of aggregation. Upon releasing its cooling energy to the cooling energy consumer, the refrigerant is evaporated and thus exits the evaporator in its gaseous state of aggregation.

The cooling system further comprises a condenser disposed in the cooling circuit. The refrigerant which is evaporated in the evaporator, via a portion of the cooling circuit downstream of the evaporator and upstream of the condenser, is supplied to the condenser in its gaseous state of aggregation. In the condenser, the refrigerant is condensed and hence exits the condenser in its liquid state of aggregation. A heat sink is adapted to provide cooling energy to the condenser. The heat sink may be a chiller or any other suitable heat sink. For example, in a cooling system employing Galden® as the two-phase refrigerant flowing through the first cooling circuit the condenser may be operated without a chiller. The heat sink then may, for example, be formed as a fin cooler or outer skin heat exchanger which is cooled by ambient air.

Cavitation in a conveying device discharging the two-phase refrigerant from the accumulator may be counteracted by appropriately subcooling the refrigerant stored in the accumulator. Subcooling of the refrigerant stored in the accumulator typically is accomplished by arranging a refrigerant inlet of the conveying device in a defined position below a refrigerant outlet disposed in the region of a sump of the accumulator. If the conveying device is arranged relative to the accumulator in such a position that for the conveying device a positive minimum inflow level, which is defined by the level of a liquid column above an inflow edge of a blade of the conveying device, is maintained, the gravity of the liquid column causes a defined pressure increase in the refrigerant supplied to the conveying device thus providing for a subcooling of the refrigerant. Upon installation of a cooling system in an aircraft it is, however, usually difficult to accommodate the system components in the limited installation space available on board the aircraft or, as described above, even position individual components relative to each other such that, for example, the gravity of a liquid column above an inflow edge of a blade of a conveying device can be utilized so as to achieve a pressure increase in a refrigerant supplied to the conveying device and thereby prevent an evaporation of the refrigerant due to the pressure reduction caused by the conveying device.

Therefore, a plurality of subcoolers is arranged in series in the cooling circuit downstream of the condenser. The subcoolers serve to subcool the refrigerant exiting the condenser and thereby ensure that the refrigerant is supplied to a conveying device for conveying the refrigerant through the cooling circuit of the cooling system and being disposed downstream of the subcoolers in its liquid state of aggregation and sufficiently subcooled such that cavitation in the conveying device due to an unintended evaporation of the refrigerant within the conveying device is prevented. As a result, excess wear of the conveying device due to cavitation can be avoided without it being necessary to arrange the conveying device below the refrigerant outlet of an accumulator in such a position that the gravity of a liquid column above an inflow edge of a blade of the conveying device can be utilized so as to achieve a pressure increase in the refrigerant supplied to the conveying device and thereby prevent an evaporation of the refrigerant. The individual components of the cooling system therefore can be arranged within a limited installation space in a flexible manner. The installation space requirements of the cooling system thus can be reduced.

Usually, at least two subcoolers are present in the cooling system according to the invention. The presence of a plurality of subcoolers arranged in series downstream of the condenser allows to at least partially compensate for a capacity overload, malfunctioning or failure of the condenser or of one or more of the subcoolers. The cooling system thus is distinguished by a high operational reliability rendering the cooling system suitable for use on board an aircraft.

Preferably, a plurality of condensers is arranged in parallel in the cooling circuit upstream of the plurality of subcoolers. Again, the presence of a plurality of condensers allows to at least partially compensate for a capacity overload, malfunctioning or failure of one or more of the condensers or of one or more of the subcoolers. The operational reliability of the cooling system thus can be further enhanced.

At least one subcooler of the plurality of subcoolers may be associated with a condenser so as to form a condenser/subcooler assembly unit. Preferably, each one of the subcoolers is associated with a condenser so as to form a condenser/subcooler assembly unit. An assembly unit comprising a subcooler and a condenser may further comprise a heat sink for providing cooling energy to the subcooler and the condenser. The heat sink may, for example, be designed in the form of a chiller. For maintenance, the assembly unit then can be disconnected from the cooling circuit of a cooling system without it being necessary to open a primary cooling circuit of the chiller. Instead, the assembly unit comprising the subcooler, the condenser and the heat sink may be disconnected from the cooling system by simply opening the more robust cooling circuit of the cooling system.

An accumulator may be disposed in the cooling circuit, in particular downstream of the condenser and upstream of the plurality of subcoolers. Refrigerant condensed in the condenser then may be received in the accumulator prior to being directed through the subcoolers. Typically, the two-phase refrigerant is stored in the accumulator in the form of a boiling liquid. The accumulator and, in particular, a housing of the accumulator therefore preferably consists of a material and is designed in such a manner that the accumulator is capable of withstanding the pressure of the boiling liquid refrigerant.

In a preferred embodiment of the cooling system a storage container is disposed in the cooling circuit downstream of the plurality of subcoolers and in particular downstream of a conveying device for discharging refrigerant from the accumulator. The storage container serve as backup reservoir for operational situations of the cooling system, wherein the volume of the accumulator is not sufficient so as to receive the entire amount of liquid refrigerant provided by the condenser. Typically the volume of the storage container is approximately three to ten times larger than the volume of the accumulator. The storage container may be connected to a refrigerant outlet of the plurality of subcoolers via a first connecting line. A first valve may be disposed in the first connecting line so as to control the supply of refrigerant from the refrigerant outlet of the subcoolers to the storage container.

The storage container may be connected to a refrigerant inlet of the subcoolers via a second connecting line. A second valve may be disposed in the second connecting line so as to control the supply of refrigerant from the storage container to the subcoolers. For example, the second valve may be adapted to allow the supply of refrigerant to the refrigerant inlet of the subcoolers from either the accumulator or the storage container. It is, however, also conceivable that the storage container, via a second connecting line, is connected to the accumulator. A second valve then may be disposed in the second connecting line so as to control the supply of refrigerant from the storage container to the accumulator.

The cooling system may further comprise a fill level detecting device which is adapted to detect a fill level of refrigerant in the accumulator. Preferably, the accumulator is designed in the form of a spherical accumulator, since the fill level detection in a spherical accumulator is easier and more reliable than in an accumulator having another shape, in particular if the accumulator is installed on board an aircraft and hence during flight is positioned in different orientations. Alternatively or additionally thereto, the cooling system may comprise a pressure detecting device which is adapted to detect a pressure of the refrigerant in the cooling circuit. The pressure detecting device may be adapted to detect the pressure of the refrigerant at different positions in the cooling circuit. To achieve this, the pressure detecting device may, for example, comprise a plurality of pressure sensors disposed at different locations in the cooling circuit. A valve control unit may be adapted to control the first and/or the second valve for regulating the flow of refrigerant to and from the storage container in dependence on signals provided to the valve control unit from the fill level detecting device and/or the pressure detecting device.

In particular, the valve control unit may be adapted to open the first valve disposed in the first connecting line if a signal provided to the valve control unit from the pressure detecting device indicates that a pressure difference between a pressure of the refrigerant in the cooling circuit upstream of the conveying device and a pressure of the refrigerant in the cooling circuit downstream of the conveying device exceeds a predetermined threshold value. For example, the valve control unit may be adapted to open the first valve if a pressure difference between a pressure of the refrigerant in the cooling circuit upstream of the conveying device and a pressure of the refrigerant in the cooling circuit downstream of the conveying device exceeds approximately 6 bar. Further, the valve control unit may be adapted to control the second valve disposed in the second connecting line so as to enable a flow of refrigerant from the storage container to the refrigerant inlet of the subcoolers or the accumulator if a signal provided to the valve control unit from the fill level detecting device indicates that the fill level of refrigerant in the accumulator is below a predetermined threshold value and a signal provided to the valve control unit from the pressure detecting device indicates that the pressure of the refrigerant in the cooling circuit is below a predetermined threshold value. In other words, the valve control unit controls the second valve such that the supply of refrigerant from the storage container to refrigerant inlet of the subcoolers or the accumulator is enabled if the fill level of refrigerant in the accumulator is low, but the system pressure indicates that there is still liquid refrigerant present in the storage container.

In a method of operating a cooling system, in particular for use on board an aircraft, a two-phase refrigerant is circulated through a cooling circuit. The refrigerant is evaporated in an evaporator disposed in the cooling circuit, and condensed in a condenser disposed in the cooling circuit. Further, the refrigerant is subcooled in a plurality of subcoolers arranged in series in the cooling circuit downstream of the condenser.

The refrigerant may be condensed in a plurality of condensers arranged in parallel in the cooling circuit upstream of the plurality of subcoolers, wherein at least one of the plurality of subcoolers preferably is associated with a condenser so as to form a condenser/subcooler assembly unit.

The refrigerant may be received in an accumulator disposed in the cooling circuit, in particular downstream of the condenser and upstream of the plurality of subcoolers.

The refrigerant may be stored in a storage container disposed in the cooling circuit downstream of the plurality of subcoolers and in particular downstream of a conveying device for discharging refrigerant from the accumulator. The storage container may be connected to a refrigerant outlet of the plurality of subcoolers via a first connecting line. A first valve may be disposed in the connecting line so as to control the supply of refrigerant from the refrigerant outlet of the subcoolers to the storage container.

The supply of refrigerant from the storage container to a refrigerant inlet of the subcoolers or the accumulator may be controlled by means of second valve which may be disposed in a second connecting line connecting the storage container to the refrigerant inlet of the subcoolers or the accumulator.

A fill level of refrigerant in the accumulator may be detected by means of a fill level detecting device. Additionally or alternatively, a pressure of the refrigerant in the cooling circuit may be detected by means of a pressure detecting device. The first and/or the second valve may be controlled by means of a valve control unit in dependence on signals provided to the valve control unit from the fill level detecting device and/or the pressure detecting device.

The valve control unit may open the first valve disposed in the first connecting line if a signal provided to the valve control unit from the pressure detecting device indicates that a pressure difference between a pressure of the refrigerant in the cooling circuit upstream of the conveying device and a pressure of the refrigerant in the cooling circuit downstream of the conveying device exceeds a predetermined threshold value. Additionally or alternatively the valve control unit may control the second valve disposed in the second connecting line so as to enable a flow of refrigerant from the storage container to the refrigerant inlet of the subcoolers or the accumulator if a signal provided to the valve control unit from the fill level detecting device indicates that the fill level of refrigerant in the accumulator is below a predetermined threshold value and a signal provided to the valve control unit from the pressure detecting device indicates that the pressure of the refrigerant in the cooling circuit is below a predetermined threshold value.

BRIEF DESCRIPTION OF DRAWINGS

Preferred embodiments of the invention now are explained in more detail with reference to the enclosed schematic drawings wherein

FIG. 1 depicts a cooling system 10 which on board an aircraft, for example, may be employed to cool food provided for supplying to the passengers. The cooling system 10 comprises a cooling circuit 12 allowing circulation of a two-phase refrigerant therethrough. The two-phase refrigerant circulating through the cooling circuit 12 may for example be $CO_2$ or R134A. Two evaporators 14*a*, 14*b* are disposed in the cooling circuit 12. Each of the evaporators 14*a*, 14*b* comprises a refrigerant inlet and a refrigerant outlet. The refrigerant flowing through the cooling circuit 12 is supplied to the refrigerant inlets of the evaporators 14*a*, 14*b* in its liquid state of aggregation. Upon flowing through the evaporators 14*a*, 14*b* the refrigerant releases its cooling energy to a cooling energy consumer which in the embodiment of a cooling system 10 depicted in FIG. 1 is formed by the food to be cooled. Upon releasing its cooling energy, the refrigerant is evaporated and hence exits the evaporators 14*a*, 14*b* at their refrigerant outlets in its gaseous state of aggregation.

Figure 1:
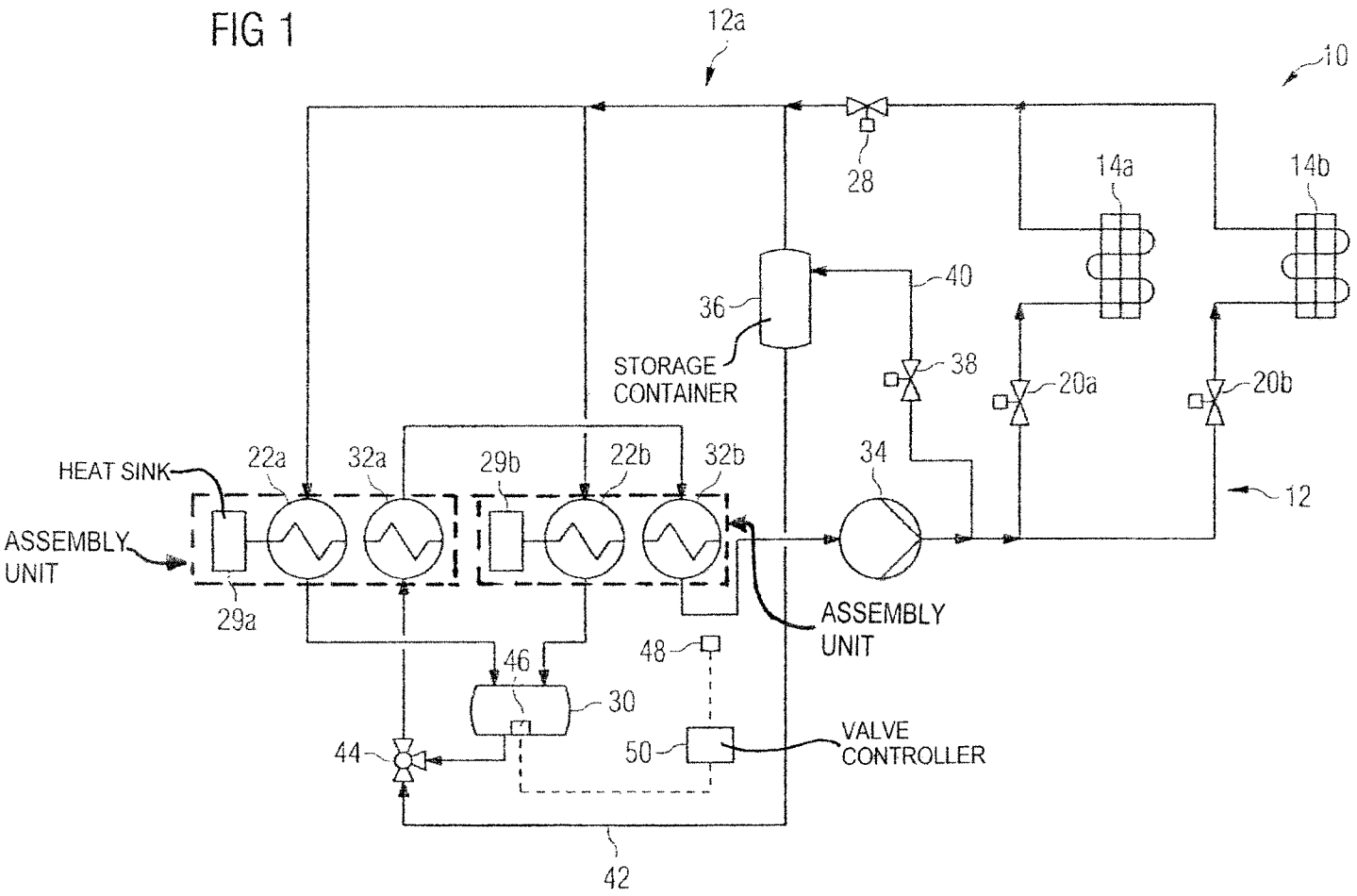
FIG. 1 shows a first embodiment of a cooling system suitable for operation with a two-phase refrigerant.

The cooling system 10 usually is operated such that a dry evaporation of the refrigerant occurs in the evaporators 14*a*, 14*b*. This allows an operation of the cooling system 10 with a limited amount of refrigerant circulating in the cooling circuit 12. As a result, the static pressure of the refrigerant prevailing in the cooling circuit 12 in the non-operating state of the cooling system 10 is low, even at high ambient temperatures. Further, negative effects of a leakage in the cooling system 10 are limited. Occurrence of a dry evaporation in the evaporators 14*a*, 14*b*, however, can only be ensured by an appropriate control of the amount of refrigerant supplied to the evaporators 14*a*, 14*b* in dependence on the operational state of the evaporators 14*a*, 14*b*, i.e. the cooling energy requirement of the cooling energy consumers coupled to the evaporators 14*a*, 14*b*.

The supply of refrigerant to the evaporators 14*a* is controlled by respective valves 20*a*, 20*b* which are disposed in the cooling circuit 12 upstream of each of the evaporators 14*a*, 14*b*. The valves 20*a*, 20*b* may comprise a nozzle for spraying the refrigerant into the evaporators 14*a*, 14*b* and to distribute the refrigerant within the evaporators 14*a*, 14*b*. The spraying of the refrigerant into the evaporators 14*a*, 14*b* may be achieved, for example, by supplying refrigerant vapor from the evaporators 14*a*, 14*b* to the nozzles of the valves 20*a*, 20*b* and/or by evaporation of the refrigerant due to a pressure decrease of the refrigerant downstream of the valves 20*a*, 20*b*.

To ensure occurrence of a dry evaporation in the evaporators 14*a*, 14*b*, a predetermined amount of refrigerant is supplied to the evaporators 14*a*, 14*b* by appropriately controlling the valves 20*a*, 20*b*. Then, a temperature TK1 of the refrigerant at the refrigerant inlets of the evaporators 14*a*, 14*b* and a temperature TA2 of the fluid to be cooled by the evaporators 14*a*, 14*b*, for example air supplied to the cooling energy consumers, is measured, preferably while a fan conveying the fluid to be cooled to the cooling energy consumers is running. Further, the pressure of the refrigerant in the evaporators 14*a*, 14*b* or at the refrigerant outlets of the evaporators 14*a*, 14*b* is measured. If a temperature difference between the temperature TA2 of the fluid to be cooled by the evaporators 14*a*, 14*b* and the temperature TK1 of the refrigerant at the refrigerant inlets of the evaporators 14*a*, 14*b* exceeds a predetermined threshold value, for example 8K, and the pressure of the refrigerant in the evaporators 14*a*, 14*b* lies within a predetermined range, the refrigerant supplied to the evaporators 14*a*, 14*b* is thoroughly evaporated and possibly also super-heated by the evaporators 14*a*, 14*b*. Hence, the valves 20*a*, 20*b* again can be controlled so as to supply a further predetermined amount of refrigerant to the evaporators 14*a*, 14*b*.

Further, the cooling system 10 comprises a first and a second condenser 22*a*, 22*b* which are arranged in parallel in the cooling circuit 12. Each condenser 22*a*, 22*b* has a refrigerant inlet and a refrigerant outlet. The refrigerant which is evaporated in the evaporators 14*a*, 14*b*, via a portion 12*a* of the cooling circuit 12 downstream of the evaporators 14*a*, 14*b* and upstream of the condensers 22*a*, 22*b*, is supplied to the refrigerant inlets of the condensers 22*a*, 22*b* in its gaseous state of aggregation. The supply of refrigerant from the evaporators 14*a*, 14*b* to the condensers 22*a*, 22*b* is controlled by means of a valve 28. The valve 28 is adapted to control the flow of refrigerant through the cooling circuit 12 such that a defined pressure gradient of the refrigerant in the portion 12*a* of the cooling circuit 12 between the refrigerant outlets of the evaporators 14*a*, 14*b* and the refrigerant inlets of the condensers 22*a*, 22*b* is adjusted. The pressure gradient of the refrigerant in the portion 12*a* of the cooling circuit 12 between the refrigerant outlets of the evaporators 14*a*, 14*b* and the refrigerant inlets of the condensers 22*a*, 22*b* induces a flow of the refrigerant from the evaporators 14*a*, 14*b* to the condensers 22*a*, 22*b*. By dosing the valve 28 the cooling circuit is separated into a high pressure portion and a low pressure portion.

Each of the condensers 22*a*, 22*b* is thermally coupled to a heat sink 29*a*, 29*b* designed in the form of a chiller. The cooling energy provided by the heat sinks 29*a*, 29*b* in the condensers 22*a*, 22*b* is used to condense the refrigerant. Thus, the refrigerant exits the condensers 22*a*, 22*b* at respective refrigerant outlets in its liquid state of aggregation. Liquid refrigerant from the condensers 22*a*, 22*b* is supplied to an accumulator 30. Within the accumulator 30 the refrigerant is stored in the form of a boiling liquid.

In the cooling circuit 12 the condensers 22*a*, 22*b* form a "low-temperature location" where the refrigerant, after being converted into its gaseous state of aggregation in the evaporators 14*a*, 14*b*, is converted back into its liquid state of aggregation. A particularly energy efficient operation of the cooling system 10 is possible, if the condensers 22*a*, 22*b* are installed at a location where heating of the condensers 22*a*, 22*b* by ambient heat is avoided as far as possible. When the cooling system 10 is employed on board an aircraft, the condensers 22*a*, 22*b* preferably are installed outside of the heated aircraft cabin behind the secondary aircraft structure, for example in the wing fairing, the belly failing or the tail cone. The same applies to the accumulator 30. Further, the condensers 22*a*, 22*b* and/or the accumulator 30 may be insulated to maintain the heat input from the ambient as low as possible.

The accumulator 30 may, for example, be an accumulator as it is described in the non-published German patent application DE 10 2011 014 943. Liquid refrigerant from a sump of the accumulator 30 is directed to a first subcooler 32*a*. The first subcooler 32*a* is associated with the first condenser 22*a* and the heat sink 29*a* so as to form a condenser/subcooler/heat sink assembly unit. Refrigerant exiting the first subcooler 32*a* is directed to a second subcooler 32*b* being arranged in series with the first subcooler 32*a* and being associated with the second condenser 22*b* and the heat sink 29*b* so as to form a condenser/subcooler/heat sink assembly unit. The subcoolers 32*a*, 32*b* serve to subcool the liquid refrigerant and to thus prevent an undesired evaporation of the refrigerant. This ensures that the refrigerant is supplied to a conveying device 34 for conveying refrigerant through the cooling circuit 12, which is embodied in the form of a pump, in its liquid state of aggregation. Thus, dry operation of the conveying device 34 and failure of the conveying device 34 can be prevented.

The cooling system 10 further comprises a storage container 36 which is disposed in the cooling circuit 12*a* downstream of a refrigerant outlet of the subcoolers 32*a*, 32*b* and downstream of the conveying device 34. The supply of refrigerant exiting the subcoolers 32*a*, 32*b* to the storage container 36 is controlled by means of a valve 38 disposed in a first connecting line 40. A second connecting line 42 connects the storage container 36 to a refrigerant inlet of the subcoolers 32*a*, 32*b*. A valve 44 is adapted to connect the refrigerant inlet of the subcoolers 32*a*, 32*b* either to the accumulator 30 or to the storage container 36.

A fill level detecting device 46 is adapted to detect a fill level of refrigerant in the accumulator 30. Further, the cooling system 10 comprises a pressure detecting device 48 which is adapted to detect a pressure of the refrigerant at different locations in the cooling circuit 12. The pressure detecting device may, for example, comprise a plurality of pressure sensors disposed at different locations in the cooling circuit 12. A valve control unit 50 serves to control the valves 38, 44 for regulating the flow of refrigerant to and from the storage container 36 in dependence on signals provided to the valve control unit 50 from the fill level detecting device 48 and the pressure detecting device 48.

In particular, the valve control unit 50 opens the valve 38 disposed in the first connecting line 40 if a signal provided to the valve control unit 50 from the pressure detecting device 48 indicates that a pressure difference between a pressure of the refrigerant in the cooling circuit 12 upstream of the conveying device 34 and a pressure of the refrigerant in the cooling circuit 12 downstream of the conveying device 34 exceeds a predetermined threshold value of, for example, 6 bar. Further, the valve control unit 50 controls the valve 44 disposed in the second connecting line 42 so as to enable a flow of refrigerant from the storage container 36 to the refrigerant inlet of the subcoolers 32*a*, 32*b* if a signal provided to the valve control unit 50 from the fill level detecting device 46 indicates that the fill level of refrigerant in the accumulator 30 is below a predetermined threshold value and a signal provided to the valve control unit 50 from the pressure detecting device 48 indicates that the pressure of the refrigerant in the cooling circuit 12 is below a predetermined threshold value.

Figure 2:
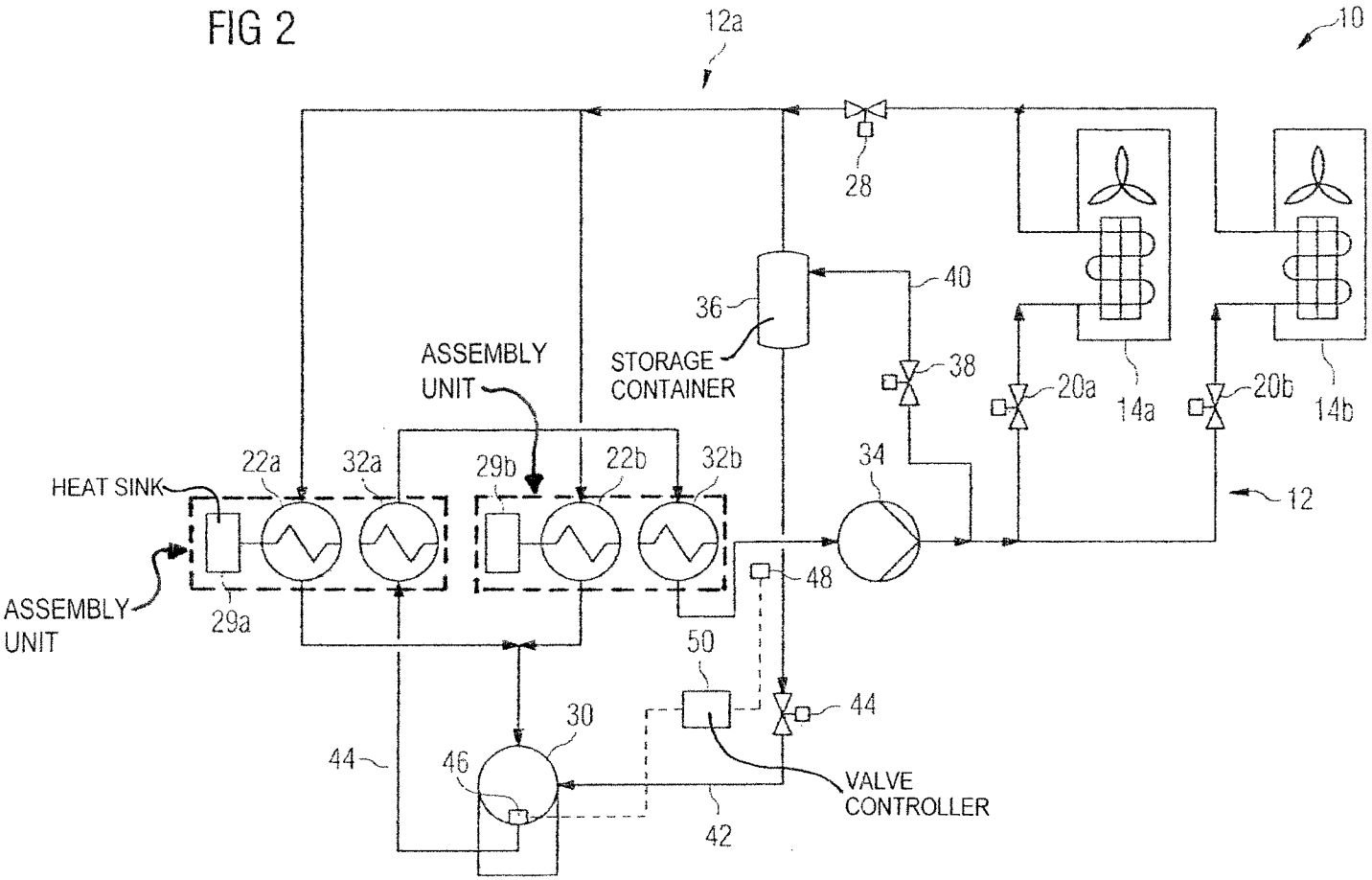
FIG. 2 shows a second embodiment of a cooling system suitable for operation with a two-phase refrigerant.

The cooling system 10 according to FIG. 2 differs from the cooling system 10 of FIG. 1 in that the accumulator 30 is designed in the form of a spherical accumulator. In a spherical accumulator 30 the fill level detection is easier and more reliable than in an accumulator 30 having another shape, in particular if the accumulator 30 is installed on board an aircraft and hence during flight is positioned in different orientations. Further, the second connection line 42 is no longer connected to the refrigerant inlet of the subcoolers 32*a*, 32*b*, but to the accumulator 30. Hence, the valve 44, under the control of the valve control unit 50, enables or disables the supply of refrigerant from the storage container 36 to the accumulator 30 as described above. Otherwise the structure and the function of the cooling system 10 according to FIG. 2 correspond to the structure and the function of the cooling system 10 of FIG. 1.

Upon start-up of any one of the cooling systems 10 depicted in FIGS. 1 and 2 the heat sinks 29*a*, 29*b* are started. Further, the fill level of refrigerant in the accumulator 30 is checked. In case the fill level of refrigerant in the accumulator 30 exceeds a predetermined threshold value, refrigerant is directed from the accumulator 30 to the storage container 36 by appropriately controlling the valves 38, 44. Thereafter, refrigerant is condensed in the condensers 22*a*, 22*b*. The liquid refrigerant thus produced is conveyed to the storage container 36. Finally, the evaporators 14*a*, 14*b* are supplied with refrigerant.

For controlling the supply of refrigerant to the evaporators 14*a*, 14*b* there are different options. As a first option, upon start-up of the cooling system 10, all evaporators 14*a*, 14*b* are simultaneously supplied with cooling energy. Typically the cooling system 10 will be designed for this start-up mode of operation. It is, however, also conceivable to control the supply of cooling energy to the evaporators 14*a*, 14*b* upon start-up of the cooling system 100 such that at first only selected ones of the evaporators 14*a*, 14*b* are supplied with cooling energy until a predetermined target temperature of the selected evaporators 14*a*, 14*b* supplied with cooling energy is reached. Only then also the remaining evaporators 14*a*, 14*b* may be supplied with cooling energy. In this start-up mode of operation the amount of heat to be discharged by means of the cooling system 10 is smaller than in a mode of operation wherein all evaporators 14*a*, 14*b* are simultaneously supplied with cooling energy. Hence, heat sinks 29*a*, 29*b* designed in the form of chillers can be operated at lower temperatures allowing heat to be discharged from the cooling energy consumers rather quickly due to the large temperature difference between the operating temperature of the heat sinks 29*a*, 29*b* and the temperature of the cooling energy consumers.

Finally, it is also conceivable to control the supply of cooling energy to the evaporators 14*a*, 14*b* upon start-up of the cooling system 10 such that at first all evaporators 14*a*, 14*b* are simultaneously supplied with cooling energy until a predetermined intermediate temperature of the evaporators 14*a*, 14*b* is reached. Immediately after start-up of the cooling system 10 the temperature difference between the operating temperature of heat sinks 29*a*, 29*b* designed in the form of chillers and the temperature of the cooling energy consumers still is high allowing a quick removal of heat from the cooling energy consumers. After reaching the predetermined intermediate temperature of the evaporators 14*a*, 14*b* the operating temperature of the heat sinks 29*a*, 29*b* may be reduced and further cooling energy may be supplied only to selected ones of the evaporators 14*a*, 14*b* until a predetermined target temperature of the selected evaporators 14*a*, 14*b* supplied with cooling energy is reached. Finally, the remaining evaporators 14*a*, 14*b* may be supplied with cooling energy until a predetermined target temperature is reached also for these evaporators 14*a*, 14*b*. Again a quick removal of heat from the cooling energy consumers may be achieved due to the large temperature difference between the operating temperature of the heat sinks 29*a*, 29*b* and the temperature of the cooling energy consumers.

Upon shut-down of the cooling system 10 the supply of refrigerant to the evaporators 14*a*, 14*b* is ceased, the fans of the evaporators 14*a*, 14*b*, however, are still operated. Further, the condensers maintain in operation at high load. Thereafter, valve 28 opens such that the pressure in the cooling circuit 12 in the region of the evaporators 14*a*, 14*b* is reduced to a predefined level. Finally, valve 28 closes so as to separate a low pressure portion of the cooling circuit 12 from a high pressure portion.

In the embodiments of a cooling system 10 described above, the accumulator 30 and the storage container 36 fulfill the double function of storing liquid refrigerant exiting the condensers 22*a*, 22*b* and, in addition thereto, of reducing the system pressure in the cooling circuit 12. The pressure reducing effect of the accumulator 30 and the storage container 36 results from the additional volume the accumulator 30 and the storage container 36 add to the volume of the cooling circuit 12 and becomes more and more significant, as the volume of the accumulator 30 and the storage container 36 increases. The importance of the pressure reduction function of the accumulator 30 and the storage container 36 increases as the operating temperature of the cooling system 10 and hence the pressure in the cooling circuit 12 increases and is of particular relevance if the cooling system 10 is operated with a refrigerant causing a high system pressure such as, for example, $CO_2$.

Basically the cooling system 10 may comprise both, the accumulator 30 and the storage container 36 as described above, and both components may serve to store liquid refrigerant exiting the condensers 22*a*, 22*b* and to reduce the system pressure in the cooling circuit 12. It is, however, also conceivable to equip the cooling system 10 with only the acculumator 30 or only the storage container 36. The accumulator 30 or the storage container 36 which is provided in such a cooling system 10 then again fulfills the double function of storing liquid refrigerant exiting the condensers 22*a*, 22*b* and of reducing the system pressure in the cooling circuit 12. Finally, a configuration of the cooling system 10 is conceivable, wherein the accumulator 30 serves to collect and to store liquid refrigerant, whereas the storage container 36, due to its additional volume, serves to reduce the system pressure.

In case the functions "storing liquid refrigerant" and "reducing system pressure" in the cooling system 10 are provided by two separate components, these components may be installed at different positions within the cooling circuit 12, allowing to more efficiently use the available installation space and to limit the size of the individual components of the cooling system 10. However, the pressure reducing storage container 36 then preferably is installed in a high pressure portion of the cooling circuit 12 in order to reliably prevent the pressure in the high pressure portion of the cooling circuit 12 from exceeding a predetermined maximum value.

Further, in case the storage container 36 merely serves to control the pressure in the cooling system 10, it is no longer necessary to provide for a direct fluid connection between the accumulator 30 and the storage container 36. Instead, the storage container 36 may be connected to the cooling circuit 12 via only a single line branching off from the cooling circuit 12, for example, upstream of one of the condensers 22*a*, 22*b* and downstream of the evaporators 14*a*, 14*b*. The line connecting the storage container 36 to the cooling circuit 12 preferably is connected to the storage container 36 at the geodetic lowest point of storage container 36. This configuration ensures that the storage container 36 is supplied only with gaseous refrigerant which is discharged from the cooling circuit 12 due to the pressure in the cooling circuit 12 exceeding a predetermined value. Of course, if desired, two storage containers 36 may be provided, in the cooling system 10, wherein a first storage container 36 may be connected to the cooling circuit 12 via a line branching off from the cooling circuit 12 upstream of the first condenser 22*a* and downstream of the evaporators 14*a*, 14*b*, and wherein a second storage container 36 may be connected to the cooling circuit 12 via a line branching off from the cooling circuit 12 upstream of the second condenser 22*b* and downstream of the evaporators 14*a*, 14*b*.

The invention claimed is:

1. A cooling system, in particular for use on board an aircraft, the cooling system comprising:

a cooling circuit allowing circulation of a two-phase refrigerant therethrough, an evaporator disposed in the cooling circuit, a condenser disposed in the cooling circuit, a plurality of subcoolers arranged in series in the cooling circuit downstream of the condenser, and a heat sink comprising a chiller having a primary circuit, wherein at least one of the plurality of subcoolers is associated with the condenser and with the heat sink, the heat sink being common to the at least one subcooler and the condenser, so as to form a condenser/subcooler/heat sink assembly unit to enable the assembly unit to be disconnected from the cooling system in a unitary fashion without opening the primary cooling circuit of the chiller.

2. The cooling system according to claim 1, wherein a plurality of condensers is arranged in parallel in the cooling circuit upstream of the plurality of subcoolers.

3. The cooling system according to claim 1, wherein an accumulator is disposed in the cooling circuit, in particular downstream of the condenser and upstream of the plurality of subcoolers.

4. The cooling system according to claim 1, further comprising a conveying device for discharging refrigerant from an accumulator and a storage container disposed in the cooling circuit downstream of the plurality of subcoolers and downstream of the conveying device, wherein the plurality of subcoolers include a refrigerant outlet and the storage container is connected to the refrigerant outlet via a first connecting line, and wherein a first valve is disposed in the first connecting line so as to control the supply of refrigerant from the refrigerant outlet of the subcoolers to the storage container.

5. The cooling system according to claim 4, wherein the plurality of subcoolers include a refrigerant inlet and the storage container is connected to the refrigerant inlet or the accumulator via a second connecting line, wherein a second valve is disposed in the second connecting line so as to control the supply of refrigerant from the storage container to the refrigerant inlet of the subcoolers or the accumulator.

6. The cooling system according to claim 5, further comprising at least one of a fill level detecting device which is adapted to detect a fill level of refrigerant in the accumulator, and a pressure detecting device which is adapted to detect a pressure of the refrigerant in the cooling circuit, and further comprising a valve control unit which is adapted to control at least one of the first and the second valve in dependence on signals provided to the valve control unit from at least one of the fill level detecting device and the pressure detecting device.

7. The cooling system according to claim 6, wherein the valve control unit is adapted to open the first valve disposed in the first connecting line if a signal provided to the valve control unit from the pressure detecting device indicates that a pressure difference between a pressure of the refrigerant in the cooling circuit upstream of the conveying device and a pressure of the refrigerant in the cooling circuit downstream of the conveying device exceeds a predetermined threshold value.

8. The cooling system according to claim 6, wherein the valve control unit is adapted to control the second valve disposed in the second connecting line so as to enable a flow of refrigerant from the storage container to the refrigerant inlet of the subcoolers or the accumulator if a signal provided to the valve control unit from the fill level detecting device indicates that the fill level of refrigerant in the accumulator is below a predetermined threshold value and a signal provided to the valve control unit from the pressure detecting device indicates that the pressure of the refrigerant in the cooling circuit is below a predetermined threshold value.

9. An aircraft comprising a cooling system according to claim 1.

10. A method of operating a cooling system, in particular for use on board an aircraft, the method comprising the steps:

circulating a two-phase refrigerant through a cooling circuit, evaporating the refrigerant in an evaporator disposed in the cooling circuit, and condensing the refrigerant in a condenser disposed in the cooling circuit, wherein the refrigerant is subcooled in a plurality of subcoolers arranged in series in the cooling circuit downstream of the condenser, wherein at least one of the plurality of subcoolers is associated with the condenser and with a heat sink comprising a chiller having a primary circuit, the heat sink being common to the at least one subcooler and the condenser so as to form a condenser/subcooler/heat sink assembly unit to enable the assembly unit to be disconnected from the cooling system in a unitary fashion without opening the primary cooling circuit of the chiller.

11. The method according to claim 10, wherein the refrigerant is condensed in a plurality of condensers arranged in parallel in the cooling circuit upstream of the plurality of subcoolers.

12. The method according to claim 10, wherein the refrigerant is received in an accumulator disposed in the cooling circuit, in particular downstream of the condenser and upstream of the plurality of subcoolers.

13. The method according to claim 10, wherein the refrigerant is stored in a storage container disposed in the cooling circuit downstream of the plurality of subcoolers and in particular downstream of a conveying device for discharging refrigerant from the accumulator, wherein the storage container is connected to a refrigerant outlet of the plurality of subcoolers via a first connecting line, and further comprising controlling, by a first valve disposed in the first connecting line, the supply of refrigerant from the refrigerant outlet of the subcoolers to the storage container.

14. The method according to claim 13, further comprising controlling, by a second valve disposed in a second connecting line connecting the storage container to the refrigerant inlet of the subcoolers or the accumulator, the supply of refrigerant from the storage container to a refrigerant inlet of the subcoolers or the accumulator.

15. The method according to claim 14, further comprising at least one of detecting, by a fill level detector, a fill level of refrigerant in the accumulator, and detecting, by a pressure detector, a pressure of the refrigerant in the cooling circuit, and further comprising controlling, by a valve controller, at least one of the first valve and the second valve in dependence on signals provided to the valve controller from at least one of the fill level detector and the pressure detector.

16. The method according to claim 15, wherein the valve controller opens the first valve disposed in the first connecting line if a signal provided to the valve controller from the pressure detector indicates that a pressure difference between a pressure of the refrigerant in the cooling circuit upstream of the conveying device and a pressure of the refrigerant in the cooling circuit downstream of the conveying device exceeds a predetermined threshold value.

17. The method according to claim 15, wherein the valve controller controls the second valve disposed in the second connecting line so as to enable a flow of refrigerant from the storage container to the refrigerant inlet of the subcoolers or the accumulator if a signal provided to the valve controller from the fill level detector indicates that the fill level of refrigerant in the accumulator is below a predetermined threshold value and a signal provided to the valve controller from the pressure detector indicates that the pressure of the refrigerant in the cooling circuit is below a predetermined threshold value.

* * * * *